US007238430B2

(12) United States Patent
McDevitt et al.

(10) Patent No.: US 7,238,430 B2
(45) **Date of Patent: *Jul. 3, 2007**

(54) COMPOSITION FOR CONTROLLING SPANGLE SIZE, A COATED STEEL PRODUCT, AND A COATING METHOD

(75) Inventors: Erin T. McDevitt, Wind Gap, PA (US); Fritz J. Friedersdorf, Earlyville, VA (US); H. E. George Rommal, Bethlehem, PA (US)

(73) Assignee: ISG Technologies Inc.DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/108,993

(22) Filed: Apr. 19, 2005

(65) Prior Publication Data

US 2005/0181229 A1 Aug. 18, 2005

Related U.S. Application Data

(63) Continuation-in-part of application No. 10/753,099, filed on Jan. 7, 2004, now Pat. No. 7,041,386, and a continuation of application No. 10/256,643, filed on Sep. 27, 2002, now Pat. No. 6,689,489, and a continuation-in-part of application No. 09/978,794, filed on Oct. 18, 2001, now Pat. No. 6,468,674, which is a continuation of application No. 09/414,766, filed on Oct. 7, 1999, now abandoned.

(51) Int. Cl.
*B32B 15/10* (2006.01)
*B05D 1/18* (2006.01)

(52) U.S. Cl. ..... 428/653; 428/411.1; 428/659; 428/939; 427/431; 427/433; 427/436

(58) Field of Classification Search ..... 428/653, 428/411.1, 659, 939; 427/431, 433, 436
See application file for complete search history.

(56) References Cited

U.S. PATENT DOCUMENTS

| | | | | |
|---|---|---|---|---|
| 4,510,183 | A * | 4/1985 | Akyol | 427/185 |
| 6,235,410 | B1 * | 5/2001 | Komatsu et al. | 428/659 |
| 6,440,582 | B1 * | 8/2002 | McDevitt et al. | 428/653 |
| 6,468,674 | B2 * | 10/2002 | Friedersdorf et al. | 428/653 |

FOREIGN PATENT DOCUMENTS

| | | | |
|---|---|---|---|
| JP | 58025468 | A * | 2/1983 |
| JP | 62-23976 | | 1/1987 |
| JP | 62-23976 | A * | 1/1987 |

OTHER PUBLICATIONS

4th Australian Conference on Nuclear Techniques of Analysis, Nov. 6-8, 1985, P 132-137 "Some Applications of Electron Spectroscopy in the Sheet Metal Industry" Mercer et. al.

* cited by examiner

*Primary Examiner*—Jennifer McNeil
*Assistant Examiner*—Aaron Austin
(74) *Attorney, Agent, or Firm*—Harold I. Masteller, Jr.

(57) ABSTRACT

A method of coating of steel products such as plate and sheet using an aluminum-zinc coating alloy includes modifying the coating bath with a particulate compound constituent in effective amounts to control the spangle facet size of the coated product, improve tension bend rust stain performance, and improve coated product paintability. Constituents include borides such as titanium boride and aluminum borides, carbides such as titanium carbide, and aluminides such as titanium aluminide. The method produces a coated steel product that does not require temper rolling for painting.

44 Claims, 7 Drawing Sheets

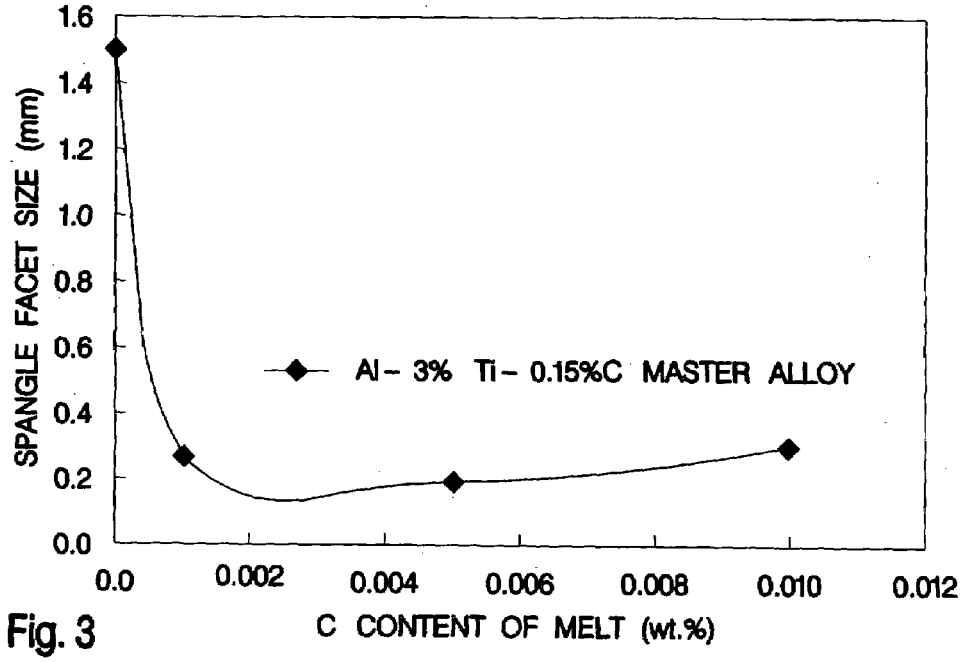
Fig. 3
Fig. 4
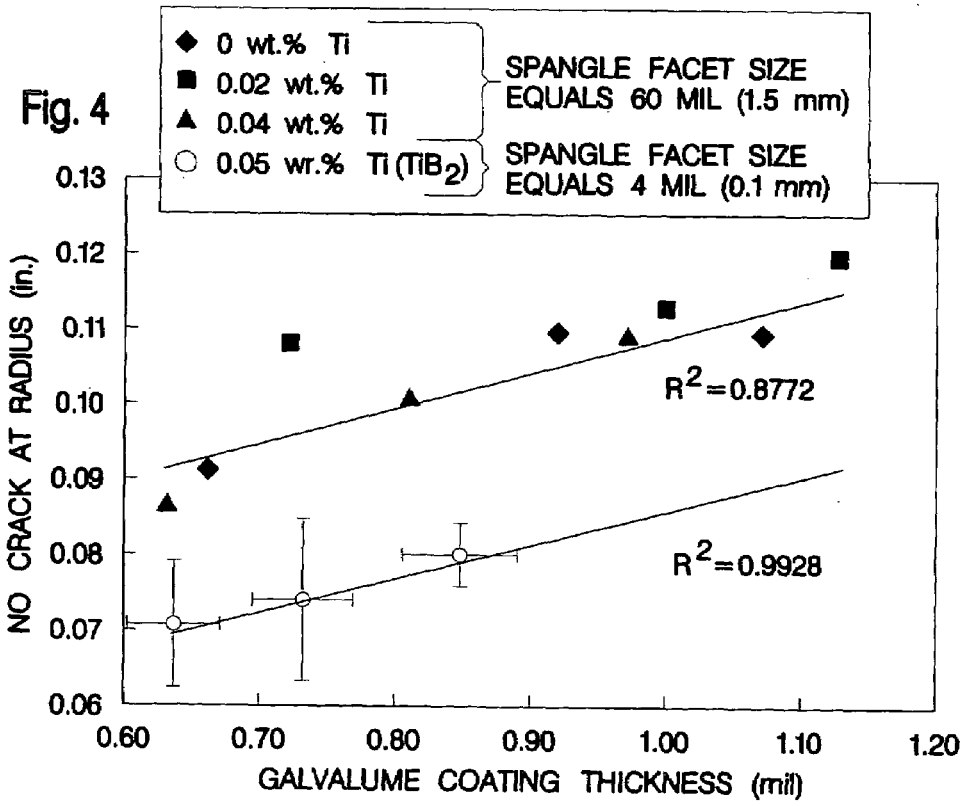

NORMAL GALVALUME - NO $TiB_2$ ADDITION

MIN. SPANGLE GALVALUME - 0.02% Ti, 0.004% B

MIN. SPANGLE GALVALUME - 0.04% Ti, 0.008% B

NORMAL GALVALUME – NO Ti ADDITION

MIN. SPANGLE GALVALUME – 0.02% Ti, 0% B

MIN. SPANGLE GALVALUME – 0.04% Ti, 0% B

NORMAL GALVALUME - NO TiC ADDITION

MIN. SPANGLE GALVALUME - 0.02% Ti, 0.001% C

MIN. SPANGLE GALVALUME - 0.2% Ti, 0.01% C

NORMAL GALVALUME – NO $AlB_{12}$ /$AlB_2$ ADDITION

MIN. SPANGLE GALVALUME – 0% Ti, 0.03% B

MIN. SPANGLE GALVALUME – 0% Ti, 0.06% B

COMPOSITION FOR CONTROLLING SPANGLE SIZE, A COATED STEEL PRODUCT, AND A COATING METHOD

This is a continuation-in-part of application Ser. No. 10/753,099, filed Jan. 7, 2004, now U.S. Pat. No. 7,041,386 a continuation of application Ser. No. 10/256,643, filed Sep. 27, 2002 now U.S. Pat. No. 6,689,489 B2 issued Feb. 10, 2004, a continuation-in-part of application Ser. No. 09/978,794 filed Oct. 18, 2001 now U.S. Pat. No. 6,468,674 B2, issued Oct. 22, 2002, which is a continuation of application Ser. No. 09/414,766 filed Oct. 7, 1999 now abandoned.

FIELD OF THE INVENTION

The present invention is directed to a coating composition, a coated steel product, and a method of making, and in particular, to an aluminum-zinc coating composition employing effective amounts of a particulate compound constituent to enhance tension bend rust stain performance and the appearance of the sheet when painted and reduce spangle facet size.

BACKGROUND ART

The coating of steel components with aluminum-based coating alloys, commonly referred to a hot dip coating, is well known in the prior art. One particular type of coating is trademarked as Galvalume®, which is owned by BIEC International, Inc., and is representative of an aluminum-zinc coating alloy.

These materials are advantageous as building materials, particularly wall and roof construction due to their corrosion resistance, durability, heat reflection, and paintability. Typically, these materials are manufactured by passing a steel product such as a sheet or plate through a bath of a melted alloy coating composition comprising aluminum, zinc, and silicon. The amount of coating applied to the steel products is controlled by wiping, and then the products are cooled. One characteristic of the coating applied to the steel product is its grain size or spangle facet size.

U.S. Pat. No. 3,343,930 to Borzillo et al., U.S. Pat. No. 5,049,202 to Willis et al. and U.S. Pat. No. 5,789,089 to Maki et al. disclose methods and techniques for the manufacture of steel sheets coated with these aluminum-zinc alloys. The three references are herein incorporated by reference in their entirety.

European Patent Application No. 0 905270 A2 to Komatsu et al. discloses another coating process utilizing zinc, aluminum, and magnesium. This application is directed at solving the corrosion problems associated with baths containing magnesium as an alloying element. Further, it is disclosed that the undesirable stripe pattern occurring in magnesium-containing baths does not occur in baths without magnesium.

U.S. Pat. No. 5,571,566 to Cho discloses another method of manufacturing coated steel sheet using an aluminum-zinc-silicon alloy. The object of the Cho patent is to provide a more efficient production method for manufacturing coated steel sheet. Cho meets this object by uniformly minimizing the size of spangles by introducing a large number of spangle particles into the coating, which limits subsequent growth of the spangles because these particles interfere with their respective growth resulting in a smaller spangle facet size. The seed effect is achieved by using titanium as part of the molten coating composition.

A similar disclosure with respect to the use of titanium in coating baths to minimize spangle facet size is disclosed in an article entitled "Minimization of Galvalume Spangle facet size By Titanium Addition To Coating Bath", by Cho, presented for the INTERZAC 94 Conference in Canada in 1994. In this article, the author indicates that elements such as titanium, boron, and chromium produce finer spangles in a Galvalume coating, such a disclosure consisted with the disclosure of the Cho patent.

Another disclosure, Japanese Patent Laid-Open Publication No. S62 (1987)-023976 to Yukio, et al., is directed to Zn—Al bath additions that include the alloying elements (Ti, B, Nb, etc.) in elemental form. Such elemental form additions cause a reaction with the Al in the Zn—Al melt to create Al—Ti, Al—B, etc. particles that act as nucleation sites for the spangle. For Ti, the process is exactly the same as that claimed by Cho, although Cho does not indicate particle formation in the melt.

In the present invention, as described in the "Detailed Description of the Preferred Embodiments," we add grain the refining particles Ti—B, Al—B, Ti—C, etc. directly to the melt to achieve grain refining. Our grain refining particles provide improved results over Yukio in that his spangle size is at least 2.5 times greater than our spangle size, and therefore, the Yukio spangle is visible to the naked eye. It is not a spangle-free product as taught by the present invention. Furthermore, Yukio indicates that making alloy additions outside his cited range leads to particle coarsening and loss of effectiveness. We are able to add large amounts of the above mentioned grain refining particles with no increase in spangle size. Accordingly, the present invention is an improvement over the Yukio teaching because pot factors that impact the particle forming reaction in the Japanese disclosure do not affect the present improved grain refining method and coated product. A person having ordinary skill in the art would not expect that grain refining particles Ti—B, Al—B, Ti—C, etc. added directly to the Zn—Al bath, as taught in the present invention, would be more effective than creating Al—X particles in situ as taught by Yukio. In addition, one skilled in the art would not expect the different Ti—B, Al—B, Ti—C, etc. particle chemistry to be more effective than the Al—Ti, etc. (all Yukio particles contain Al) particle chemistry taught by Yukio.

In yet another disclosure published in the Fourth Australian Conference on Nuclear Techniques of Analysis, an article by Mercer, et al. entitled "Some Applications of Electron Spectroscopy in the Sheet Metal Industry," provides a brief discussion of Al—Zn coating grain size in section 2.3 (page 135). However, based on an Interview Summary in the above listed priority application Ser. No. 10/753,099, the Examiner stated that Mercer does not constitute prior art that can be cited against the patent claims in the above listed priority U.S. Pat. No. 6,468,674. The Examiner believes that the Mercer, et al. article does not establish a working knowledge about the intentional usage of boride constituents in an Al—Zn coating bath, and the article does not show or reasonably suggest any benefits of using boride constituents. According Mercer should not be considered prior art in the present invention.

Notwithstanding the improvements suggested by Cho and Yukio, presently used coated steel products still have disadvantages. One disadvantage is that, when the coated steel product is to be painted, a temper rolling is required to flatten the product in preparation for painting. Another problem is cracking when the product is a sheet and is bent. When this sheet product is bent, the coating can crack, the crack exposing the steel to the environment and premature corrosion. With presently available coated steel sheets, large cracks can form, thereby compromising the corrosion resistance of the sheet product.

In light of the deficiencies in the prior art, a need has developed to provide an aluminum-zinc coated steel product with improved bending performance, reduced spangle facet size, and improved painted surface appearance. The present invention solves this need by providing a method of coating a steel product, a coating composition and a coated steel article which, when experiencing surface cracking during bending, is still corrosion resistant and does not require temper rolling when the coated steel product is painted. The coating composition is modified with one or more particulate compound constituents such as titanium boride, aluminum boride and the like.

SUMMARY OF THE INVENTION

Accordingly, it is a first object of the present invention to provide an improved hot dip coating composition for steel products.

Another object of the present invention is a method of coating a steel product using a modified aluminum-zinc coating alloy.

Still further objects of the present invention are to provide a coated steel product with enhanced tension bend rust stain performance and painted appearance.

One other object of the present invention is a coated steel article employing a modified coating alloy composition.

Yet another object of the invention is a method of coating and then painting a steel product, whereby the coated steel product does not require temper rolling before painting.

One other object of the present invention is a coated steel article having a uniform, consistent spangle size of between about 400 to 500 microns.

Other objects and advantages of the present invention will become apparent as a description thereof proceeds.

In satisfaction of the foregoing objects and advantages, the present invention is an improvement in the art of hot dip coating of steel products using an aluminum-zinc coating alloy. The composition of the aluminum-zinc alloy is modified by adding an effective amount of one or more of a particulate compound constituent selected from the group consisting of boride compounds having one of titanium and aluminum, aluminide compounds containing titanium and iron, and carbide compounds containing titanium, vanadium, tungsten, and iron. Preferably, the constituent is one of TiC, $TiB_2$, $AlB_2$, $AlB_{12}$, and $TiAl_3$.

The constituent can be prepared in various ways as part of the modification step, e.g., as part of a precursor or master alloy ingot or bath containing principally aluminum, the master alloy then added to an aluminum-zinc bath in the necessary proportions to arrive at a final bath composition suitable for coating and providing the benefits of the invention as a result of the modifier constituent. The constituent can be added to the master alloy as particulate compounds or can be formed in-situ in the master alloy to add to the actual coating bath.

More particularly, the composition of the coating bath can be modified by: (1) directly adding the particles (as a powder) to the coating bath or a pre-melt pot which feeds the coating bath; (2) adding an ingot than contains the required particles; the ingot may be aluminum with particles, zinc with particles, a zinc-aluminum alloy with particles, etc.; the ingot may be added to a main coating pot or a pre-melt pot; (3) adding molten bath containing the required particles, wherein the liquid may be aluminum with particles, zinc with particles, a zinc-aluminum alloy with particles, etc.; (4) in-situ reaction in the main pot or pre-melt pot, for example by the reaction of elemental species, such as titanium and boron in an aluminum feed melt, or the reaction of salts on the feed melt pot to produce particles.

The particle size of the constituent in the coating bath can vary but preferably ranges from about 0.01 and 25 microns. When practicing the invention, a spangle facet size of a coated product can range as low as 0.05 mm and up to 2.0 mm.

The effective amount of the constituent is considered to be that amount which reduces the spangle facet size of the coated product, causes an increase in the number of cracks while maintaining a smaller crack size than conventional aluminum-zinc coated products, and does not require temper rolling when painting. An overall weight percentage range of the constituent, boride, carbide, or aluminide, based on the alloy bath is believed to be between about 0.0005 and 3.5%. When the constituent is a boride, a preferred weight percentage of the constituent as part of the coating bath can range between about 0.001 and 0.5%. When the constituent is a carbide, a preferred weight percentage can range between about 0.0005 and 0.01%.

The invention also provides a coated steel article employing a coating containing the particulate compound constituent as well as the coating composition as applied to the steel product. The product is preferably a steel sheet or plate for construction purposes.

BRIEF DESCRIPTION OF THE DRAWINGS

Reference is now made to the drawings of the invention wherein:

FIG. 3 is a graph comparing the use of titanium carbide as a melt additive for hot dip coating in terms of spangle facet size and carbon content.

FIG. 4 is a graph showing bend test result comparisons for coating compositions modified with titanium and titanium boride.

DESCRIPTION OF THE PREFERRED EMBODIMENTS

Figure 1:
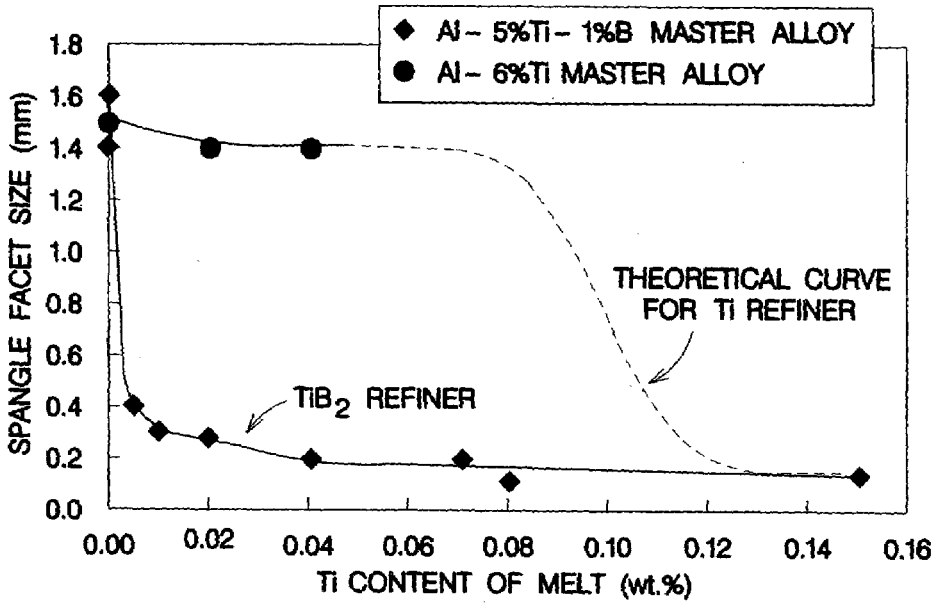
FIG. 1 is a graph comparing the use of titanium boride and titanium as melt additives for hot dip coating in terms of spangle facet size and titanium content.

The present invention advances the art of hot dipping or coating steel products, particularly plate and sheet products, using an aluminum-zinc molten alloy bath, e.g., a Galvalume bath. According to the invention, the coating bath is modified with particulate compound constituents to reduce the spangle facet size of the coated steel product. With the addition of the particulate constituents, improvements may also be realized in the performance of the coated steel product in terms of tension bend rust staining. Tension bend rust staining is a discrete pattern of cosmetic red rust running along the rib of a prepainted, roll formed, building panel caused by cracking of the metallic coating and paint.

The surface of the coated steel product also yields a painted appearance that is superior to conventional Galvalume product. This is believed to allow for the production of smooth coated steel sheet product without the need for temper rolling. Eliminating the extra processing step of temper rolling also reduces energy consumption, eliminates possible waste streams associated with temper rolling, and simplifies the production process.

In its broadest embodiments, the invention entails a novel composition for a coating of steel product, a method of making such a coating, and the article made from such method.

When coating steel products with an aluminum-zinc coating bath, the processing steps of forming the bath to the desired composition and passing the steel product to be coated through the bath are well-known. As a result, a further description of the prior art methods and apparatus to accomplish this conventional coating is not deemed necessary for understanding of the invention.

The composition of the prior art aluminum-zinc alloy baths is well-known as discussed in the Borzillo et al. and Cho patents, and the Cho publication noted above. Generally, this bath comprises about 55% aluminum, a level of silicon, generally about 1.6% by weight, and the balance zinc. Other variations in the composition are within the scope of the invention as would be conventionally known to those of ordinary skill in the art. For example, Borzillo clearly teaches that such an aluminum-zinc bath, and the resulting aluminum-zinc coating applied to a hot-dip product, may contain between 25% and 70% aluminum by weight.

According to the invention, the aluminum-zinc molten bath is modified with a particulate compound constituent to achieve improvements in terms of reduced spangle facet size, improved surface finish, reduction in crack size, and potential improvements in tension bend rust staining. The particulate compound constituent can be a boride, carbide, or aluminide. Preferably, the boride compounds include titanium boride ($TiB_2$), and aluminum boride ($AlB_2$ and $AlB_{12}$). The particulate compound constituent as a carbide can be titanium carbide, vanadium carbide, tungsten carbide, and iron carbide, and as an aluminide, titanium aluminide ($TiAl_3$) and iron aluminide. The level of the particulate compound constituent is set as an amount to effectively reduce the spangle facet size over that of conventional coatings, with or without elemental titanium. While the effective amount may vary depending on which compound is selected, it is anticipated that the amount would range from about 0.0005% to about 3.5% by weight of the carbon, boron, or aluminide of the composition of the coating bath. For carbon, a more preferred range is between about 0.005% and 0.10% by weight of the bath. In terms of titanium concentration, a titanium boride containing coating melt bath could have a titanium concentration between about 0.001% and 0.1% by weight of the bath. For the boride compound, the boron weight percentage in the bath can range from 0.001% to 0.5% by weight.

Table 1 shows broad claimed ranges for the particle additions if only a single type of particle is added:

TABLE 1

| | Coating Bath Composition (wt. %) Nominally 55% Al—1.6% Si-bal. Zn | | | Wt. % Particle in |
|---|---|---|---|---|
| | Ti | B | C | the melt |
| $TiB_2$ | 0.002-1.0 | 0.001-0.5 | — | 0.007-3.5 |
| $AlB_2$ | — | 0.001-0.5 | — | 0.010-5.0 |
| $AlB_{12}$ | — | 0.001-0.5 | — | 0.005-2.5 |
| TiC | 0.0019-1.9 | — | 0.0005-0.5 | 0.0025-2.5 |

For example, for 100 g of melt, the amount of $TiB_2$ particle addition should be 0.007-3.5 grams.

The values in Table 1 assume stoichiometric additions. Excess Ti (in the case of TiC or $TiB_2$) is permissible, but not necessary.

Table 2 shows preferred ranges or optimal ranges for the particle additions:

TABLE 2

| Particle | Coating Bath Composition (wt. %) nominally 55% Al—1.6% Si-bal. Zn | | | wt. % Particles in |
|---|---|---|---|---|
| Type | Ti | B | C | the melt |
| $TiB_2$ | 0.01-0.05 | 0.002-0.1 | — | 0.014-0.7 |
| $AlB_2$ | — | 0.02-0.05 | — | 0.2-0.5 |
| $AlB_{12}$ | — | 0.02-0.05 | — | 0.2-0.5 |
| TiC | 0.011-0.38 | — | 0.003-0.1 | 0.015-0.5 |

The particle size of the particulate constituent should range between about 0.01 and about 25 microns. By coating a steel product using the inventive method, spangle facet sizes are produced which range from as low as 0.05 mm up to 2.0 mm. However, it has been discovered that when the molten Al—Zn bath contains boron in an amount between 0.001% to about 0.5% by weight, a modified aluminum-zinc coating having a spangle facet size between about 0.5 mm to about 0.05, is produced on the surface of steel sheet dipped into the molten aluminum-zinc bath.

The molten bath used to coat this steel product containing the modified aluminum-zinc alloy composition can be prepared in a number of ways. In one method, a master alloy of aluminum is prepared and is modified with the particulate compound constituent. This bath is then added to an aluminum-zinc coating bath, the proportions of the two baths calculated to arrive at a target bath composition containing the effective amount of the particulate compound constituent. The modified alloy bath would still track the conventional weight percentages of the aluminum, zinc and silicon for these types of coating baths, e.g., about 55% aluminum, 1-2% silicon, the balance zinc, since the effective amount of the particular compound constituent is a relatively low weight percentage of the overall bath amount. Methods for making master alloys are taught in U.S. Pat. No. 5,415,708 to Young et al. and U.S. Pat. No. 3,785,807, both herein incorporated by reference in their entirety.

Considering the above teaching, when the aluminum master alloy comprises a boride particulate compound, the amount of master alloy that needs to be added to the coating bath can be calculated with the following exemplary equation.

$$\frac{X * Y}{Z + Y} = W \text{ where } X > W$$

In the equation, X is the weight fraction of the boride compound, or the carbide compound contained in the master alloy. The mass of the master alloy is represented as Y, and the mass for the aluminum-zinc coating bath is represented as Z. The weight % boron or carbon contained in the aluminum-zinc coating bath after the master alloy is added to the bath is W; where 0.001% to about 0.5% by weight boron is present in the boride compound in the aluminum-zinc alloy bath, and where 0.0005% to about 0.01% carbon is present in the carbide compound in the aluminum-zinc alloy bath. When the molten Al—Zn bath contains boron in an amount between 0.001% to about 0.5% by weight, a modified aluminum-zinc coating, having a spangle facet size between about 0.5 mm to about 0.05 mm, is produced on the surface of steel sheet dipped into the molten coating bath.

For example, if the aluminum master alloy contains a boride compound in an amount where the weight fraction X=0.5 and if the desired concentration in the coating bath is 0.005% by weight boron, i.e. W=0.005, about 1212 pounds of the aluminum master alloy must be added to the coating bath to achieve an effective amount of boron as follows.

$$\frac{(0.5)(Y)}{(120000 + Y)} = 0.005$$

$$Y = \frac{(0.005)(120000)}{(0.5 - 0.005)}$$

$$Y = 1212 \text{ Pounds about 550 kg}$$

Similarly, if the master alloy contains a carbide compound in a weight fraction amount X=0.5 and desired concentration of carbon by weight in the coating bath is W=0.005%, about 24 pounds of aluminum master alloy must be added to achieve an effective amount of carbon as follows.

$$\frac{(0.5)(Y)}{(120000 + Y)} = 0.0001$$

$$Y = \frac{(0.0001)(120000)}{(0.5 - 0.0001)}$$

$$Y = 24 \text{ Pounds about 11 kg}$$

Secondly, the master alloy containing the particles could be added to the coating bath in the form of a solid ingot. The ingot may be primarily Al, primarily Zn, or an alloy containing Zn, Al, and/or Si along with the spangle refining particles.

Alternatively, the particulate compound constituents could be added directly to the aluminum-zinc bath prior to coating a steel product.

When using aluminum boride as a bath modifier, boron particles can be added to an aluminum master alloy to facilitate incorporation of the particles into the melt and improve even distribution of the particles throughout the melt. Alternatively, aluminum boride particles can be added to the aluminum-zinc bath in the appropriate amounts.

When producing an aluminum master alloy with the particulate compound constituents such as titanium boride, some excess titanium may exist in the bath. This excess may range from 0.01% to 10% relative to the total mass of boron added. In terms of the stoichiometry, titanium additions in excess of one mole of titanium for 2 moles of boron may range from 0.002 to 4.5 excess moles. It is not believed that the excess titanium, whether present through the use of titanium boride or another titanium-containing compound such as titanium carbide or the like, is necessary to obtain the spangle refinement associated with the invention.

In preparing the alloy bath for coating, the particulate compound constituent can be introduced as a powder or formed in the bath itself. For example, titanium boride powders could be added to an aluminum bath in the appropriate weight percentages. Alternatively, elemental titanium and boron could be added to an aluminum melt and heated at sufficiently high temperatures to form titanium boride particles therein. It is preferred that the compound particles be added to the master alloy since this processing is much more effective in terms of energy consumption. Similar processing techniques can be employed for the carbides and aluminides.

It is believed that the presence of titanium and boron in a coating bath alone will not produce the grain refining benefits demonstrated above as compared to adding a compound particulate such as titanium boride. It has been reported that in aluminum casting, the separate addition of titanium and boron to an aluminum melt did not produce titanium boride particles when added at temperatures below 1000° C. (1832° F.). Instead, the titanium reacted with the aluminum to form $TiAl_3$ particles. Since the coating process is generally conducted at much lower temperatures, i.e., 593° C. (1100° F.), adding titanium, and boron in elemental form to an Al—Zn coating bath would produce similar behavior. In addition, the kinetics of titanium and boron dissolution will be very slow at the low temperatures associated with the coating method. Thus, when forming the titanium boride in the bath itself, it is necessary to go beyond conventional melting parameters to achieve the necessary particulate for use in the invention.

The inventive coating method produces a coated article, wherein the coating has a coating composition including the added particulate compound constituent described above. The coated product can then be painted as is known in the art without the need for temper rolling or skin passing.

While titanium and aluminum borides, and titanium aluminide have been exemplified as spangle refiners, other carbides, such as vanadium carbide, tungsten carbide, iron carbide, and aluminum compounds such as iron aluminide, are also believed to be within the scope of the invention.

In order to demonstrate the unexpected benefits associated with the invention, studies were done comparing coated steel products using an aluminum titanium master alloy and an aluminum titanium boride master alloy. These master alloys were added to the aluminum-zinc coating alloys to form a coating bath for the steel to be tested. FIG. 1 compares two curves based on the master alloys noted above, the curves relating spangle facet size and the titanium content of the melt in weight percent. As is evident from FIG. 1, the use of a master alloy with titanium boride significantly refines the spangle facet size, particularly at much lower additional levels of titanium. For example, at a titanium content of 0.02% by weight, the reported spangle facet size is about 0.3 mm as compared to a spangle facet size of 1.4 mm when only titanium is used. Thus, not only does the boride modifier reduce spangle facet size, it also reduces cost by lowering the amount of titanium needed.

Figure 2:
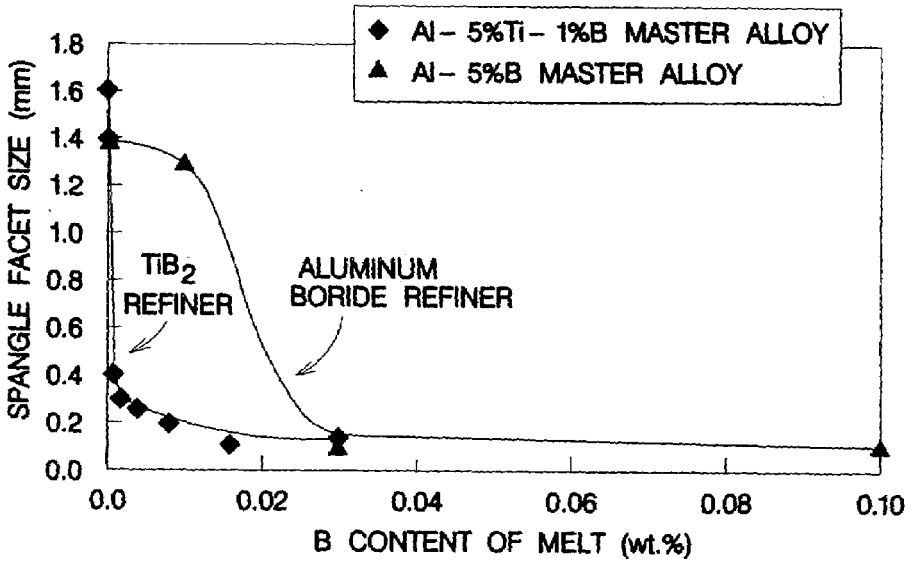
FIG. 2 is a graph comparing the use of titanium boride and aluminum boride as melt additives for hot dip coating in terms of spangle facet size and boron content.

FIG. 2 shows a similar comparison between a master alloy containing titanium boride and a master alloy of aluminum and boron. FIG. 2 shows that the titanium boride refiner achieves a smaller spangle facet size for boron levels up to about 0.03% by weight, when compared to a master alloy of just aluminum and boron. However, when comparing FIGS. 1 and 2, the use of an aluminum boride particulate compound constituent to reduce spangle facet size is more effective than just titanium.

FIG. 3 shows a graph exhibiting behavior for a coating composition modified with titanium carbide that is similar to the $TiB_2$-modified coating of FIG. 1.

Besides minimizing the spangle facet size, the use of the particulate compound constituent according to the invention also allows the coated steel product to tolerate more severe bending without cracking. Referring now to FIG. 4, a comparison is made between products coated with a coating bath alloy composition employing just titanium and one employing 0.05% weight titanium boride. The spangle facet size is decreased from 1.5 mm to 0.1 mm when titanium boride is used. When the coated products are subjected to conical bend tests, the coating thickness of the product was plotted against the radius at which no crack occurred. Conical bend tests are tests that generally follow ASTM D522-93*a*. The product employing titanium boride as a particulate compound constituent in the coating bath decreased the no-crack radius by 23%.

Figure 5:
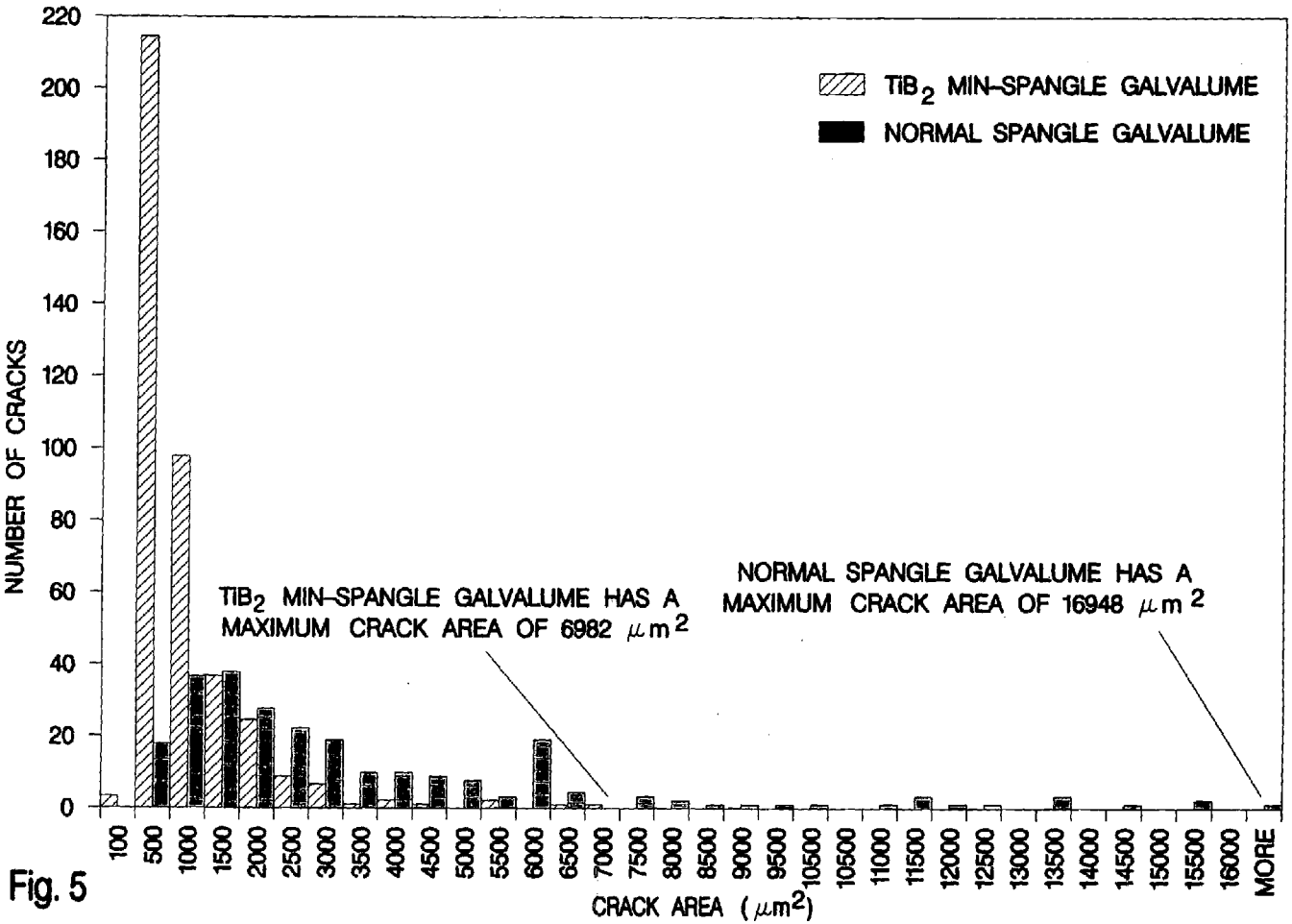
FIG. 5 is a graph comparing crack area and number of cracks for a coating composition containing titanium boride and a conventional coated steel product.

Another unexpected result associated with the invention is the formation of more numerous but small cracks during bending as compared to conventional aluminum-zinc alloy coatings of sheet product. Referring to FIG. 5, it can be seen that the titanium boride-modified aluminum zinc coated steel product has a significantly higher number of cracks than conventional aluminum zinc. However, the conventional product has a significantly increased crack area as compared to the titanium boride modified product. The smaller but more uniformly distributed cracks of the invention promote crack bridging by paint films. This bridging then facilitates choking off of corrosion products quicker than the larger cracks associated with conventional aluminum zinc coatings would. Thus, the titanium boride-coated product would exhibit improved corrosion resistance over prior art products.

The graph of FIG. 5 was based on bending a coated sample on a 1/16" cylindrical bend. The size of the cracks were measured after bending and a 19.71 square millimeter surface portion was examined for the number of cracks and their size. The maximum crack size in the inventive product is less than half (41%) of the size of the maximum crack size in the conventional product. This behavior is beneficial in preventing or reducing tension bend rust staining, where it is thought that the size of the worst cracks are what control the tension bend rust staining behavior of a coating.

Another equally important attribute of the invention is the surface quality of the inventive coated steel product and its improved suitability for painting. Table 3 shows profilometry results for a number of conventionally aluminum-zinc coated products and products coated with the titanium boride modified aluminum zinc alloy. The conventional product is noted as a Galvalume coating in Table 3. This table shows that the surface waviness ($W_{ca}$) of the coated product of the invention is substantially lower than the as-coated and temper rolled conventional Galvalume product. The average waviness of the as-coated and titanium boride-modified sheet is 67% better than the as-coated regular Galvalume product produced under identical conditions. The minimal spangle Galvalume waviness with the product of the invention is 50% better than the larger spangle mill produced temper rolled Galvalume. The titanium boride-modified minimum spangle Galvalume does not require temper rolling to reduce waviness, and is ideal for high speed coil coating applications. The appearance of the painted product is superior to large spangled as-coated and skin-passed Galvalume.

TABLE 3

Profilometry Results For A Number Of Conventional Galvalume Coatings And $TiB_2$, Modified Minimum Spangle Galvalume

| Coating Process/Line | Surface ID/ Condition | $R_a$(μin) | $R_t$(μin) | $W_{ca}$(μin) | PC(ppi) |
|---|---|---|---|---|---|
| Galvalume w/$TiB_2$ Master Alloy Pilot Line | As-coated | 24.3 | 273.4 | 15.9 | 167 |
| Conventional Galvalume Average Mill Produced Galvalume | As-coated | 16.7 | 196.1 | 48.4 | 58.0 |
| | As-coated | 21.6 | 271.2 | 61.3 | 97.5 |
| | Temper Rolled | 47.3 | 354.9 | 39.6 | 153.5 |

Figure 6A:
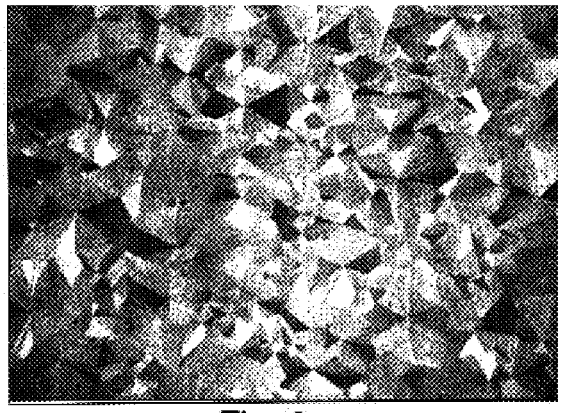
FIGS. 6*a*-6*c* are photomicrographs showing spangle facet size for a conventionally coated product and a $TiB_2$-modified product.
Figure 6B:
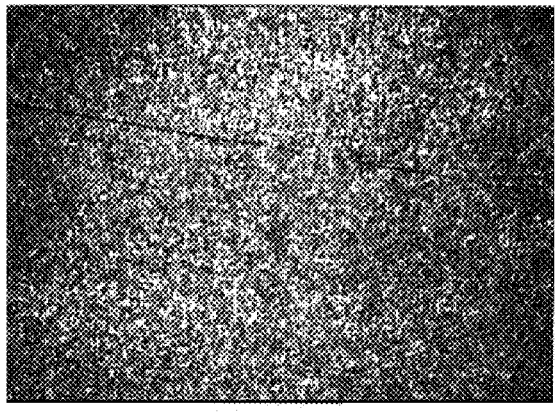
Figure 6C:
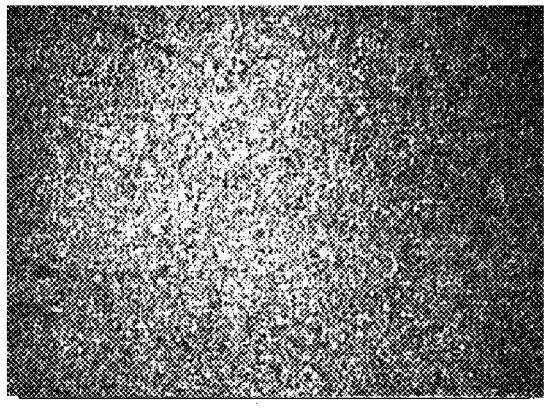
Figure 7A:
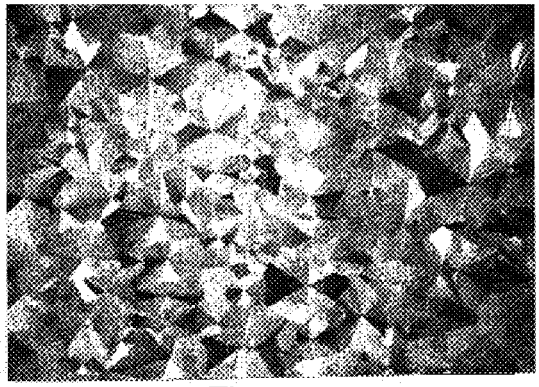
FIGS. 7*a*-7*c* are photomicrographs showing spangle facet size for a conventionally coated product with and without titanium.
Figure 7B:
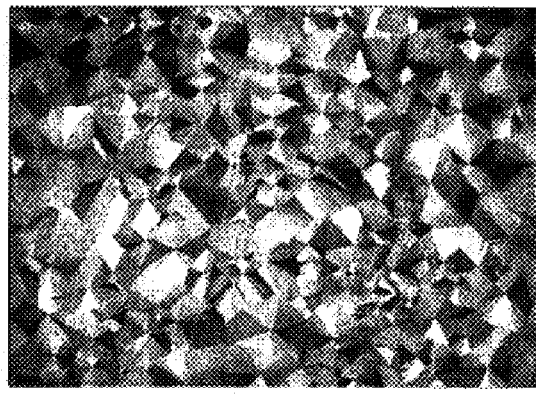
Figure 7C:
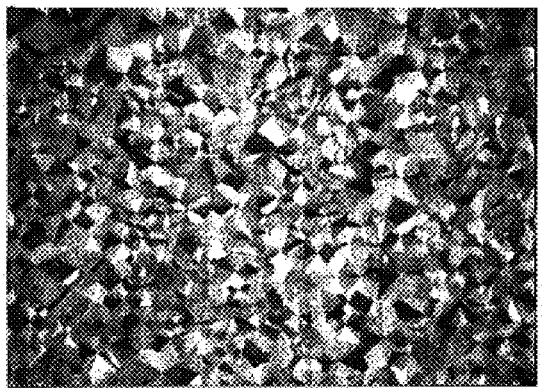
Figure 8A:
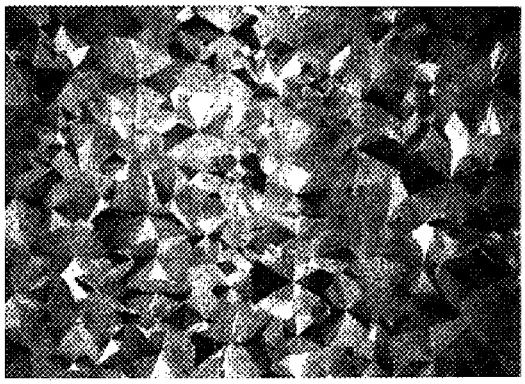
FIGS. 8*a*-8*c* are photomicrographs showing spangle facet size for a conventionally coated product and a TiC-modified product.
Figure 8B:
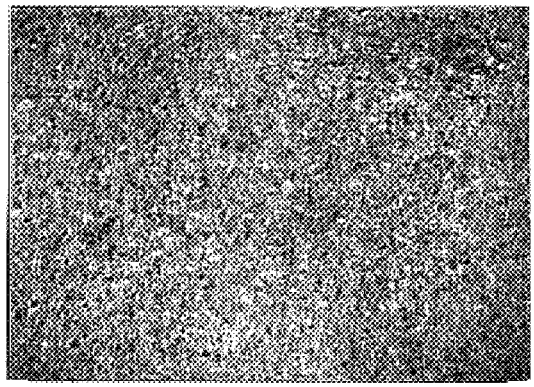
Figure 8C:
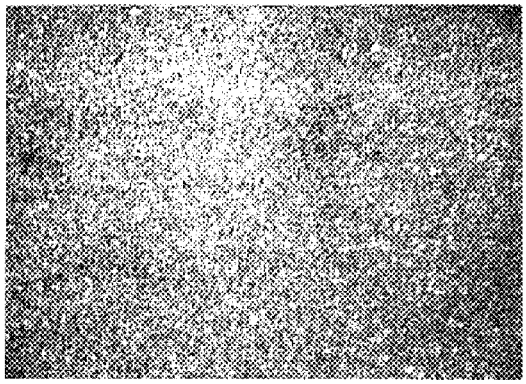
Figure 9A:
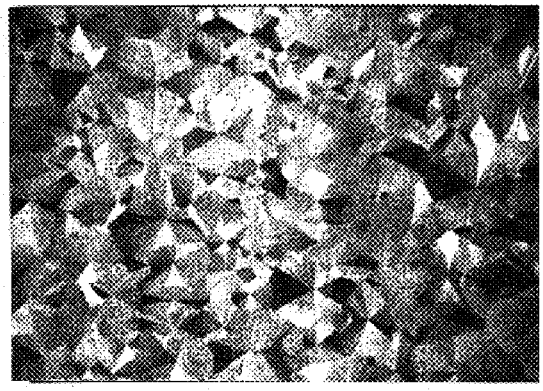
FIGS. 9*a*-9*c* are photomicrographs showing spangle facet size for a conventionally coated product and an $AlB_2$—$AlB_{12}$ modified product.
Figure 9B:
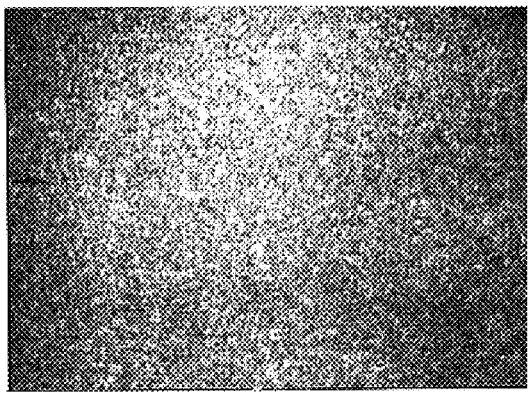
Figure 9C:
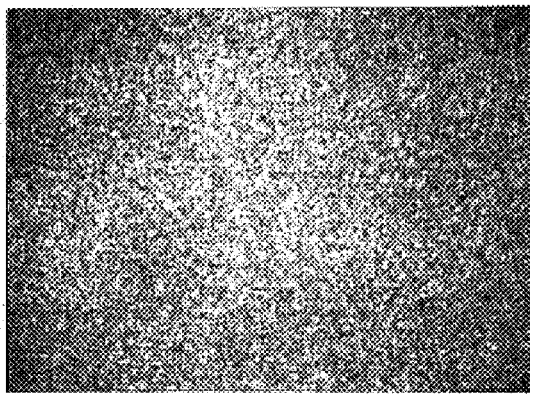

FIGS. 6A-9C compare the invention to the prior art and demonstrate the reduction in spangle facet size. FIGS. 6A-6C show the effect of $TiB_2$ added in the form of a Al-5% Ti-1% B master alloy, wherein a significant refinement of spangle facet size is achieved as compared to conventional Galvalume coatings. Similar reductions in spangle facet size are shown in FIGS. 8A-8C and 9A-9C when titanium carbide and aluminum borides are used as modifiers. Most importantly, when comparing FIGS. 6A-6C and FIGS. 7A-7C, particularly, FIGS. 6C and 7C, the addition of titanium alone does not produce the same spangle facet size reduction. In fact, the presence of titanium alone as compared to $TiB_2$ only marginally decreases spangle facet size.

If boride additions fall below a specific concentration range, the appearance of the spangle size in the hot-dip coating becomes non-uniform and inconsistent within the same coil as well as from coil to coil. On the other hand, when boride additions are greater than the specific range, spangle size is no longer visible to the naked eye. Additionally, at the lower boride concentration levels, below the specific range, the small additions to the hot-dip bath are difficult to measure and control, adding to the problem of inconsistency in spangle size.

In certain instances, visual spangle size is desirable in Galvalume like hot-dip coated products. Such visibly spangled products are widely used in large construction applications, for example, roofing and siding in large industrial and agricultural type structures. However, customers view inconsistent spangle size as a coating quality problem as well as an aesthetic problem. Variation in spangle size manifests itself as a non-uniform appearance from panel to panel on the roof or sides of a building, which in turn is objectionable to the building owner.

A more uniform, consistent spangle size may be produced by adding a small amount of TiB2 grain refiner to the hot-dip coating bath. By making bath additions of between about 0.0008-0.0012% by weight boron in the form of boride particles to the bath we are able to produce a consistent spangle facet size of between about 400 to 500 microns (measured using the mean intercept length method described in ASTM E112). Producers and customers consider such controlled spangle size products superior in visual appearance as compared to a conventional spangle aluminum-zinc coated product where boride additions fall outside the specified range.

As such, an invention has been disclosed in terms of preferred embodiments thereof that fulfills each and every one of the objects of the present invention as set forth above and provides new and improved coated steel product, a method of making and a coating composition therefore.

Of course, various changes, modifications, and alterations from the teachings of the present invention may be contemplated by those skilled in the art without departing from the intended spirit and scope thereof. It is intended that the present invention only be limited by the terms of the appended claims.

What is claimed is:

1. In a coated steel article comprising a steel substrate; and an aluminum-zinc coating thereon, the improvement comprising said aluminum-zinc coating modified with an effective amount of one or more of a particulate compound constituent having a particle size between about 0.01 microns and about 25 microns, said particulate compound constituent selected from the group consisting of a boride compound containing titanium, a boride compound containing aluminum, an aluminide compound containing titanium, an aluminide compound containing iron, a carbide compound containing titanium, a carbide compound containing vanadium, a carbide compound containing iron, and a carbide compound containing tungsten, said aluminum-zinc coating having a spangle facet size of about 0.5 mm and smaller.

2. The article of claim 1, wherein the aluminum-zinc coating contains between about 25% and 70% by weight aluminum.

3. In an aluminum-zinc steel product coating composition containing between about 25% and 70% by weight aluminum, the improvement comprising the aluminum-zinc alloy including an effective amount of one or more of a particulate compound constituent having a particle size between about 0.01 microns and about 25 microns, said particulate compound constituent selected from the group consisting of titanium boride a carbide compound containing titanium, a carbide compound containing vanadium, a carbide compound containing iron, and a carbide compound containing tungsten, whereby said selected constituent particles provide a facet size of about 0.5 mm and smaller when the aluminum-zinc alloy is applied as a coating to the steel product.

4. In a coated steel article comprising a steel substrate; and an aluminum-zinc coating thereon, the improvement comprising the aluminum-zinc coating modified with an effective amount of one or more of a particulate compound constituent having a particle size between about 0.01 microns and about 25 microns, said particulate compound constituent selected from the group consisting of a boride compound containing titanium, a boride compound containing aluminum, an aluminide compound containing titanium, an aluminide compound containing iron, a carbide compound containing titanium, a carbide compound containing vanadium, a carbide compound containing iron, and a carbide compound containing tungsten, whereby when the particulate compound constituent is said boride compound, said modified coating is applied to the article in an aluminum-zinc alloy bath having a mass Z, said bath including an aluminum master alloy addition having a mass Y and a weight fraction X of said boride compound so that when said master alloy is added to said aluminum-zinc alloy bath in an amount calculated with the following equation $$\frac{X \times Y}{Z + Y} = W \text{ where } X > W$$

so that an effective amount W comprising between about 0.001% to about 0.5% by weight boron is present in said boride compound in said modified coating, said modified coating having a spangle facet size between about 0.05 mm and 0.5 mm.

5. The article of claim 4, wherein the particulate compound constituent is one of $TiB_2$, $AlB_2$, and $AlB_{12}$.

6. The article of claim 4, wherein the aluminum-zinc alloy bath contains between about 25% and 70% by weight aluminum.

7. The article of claim 4, further comprising a painted surface on the coated steel article.

8. The article of claim 4, whereby when the particulate compound constituent is said carbide compound, said modified coating is applied to the article in an aluminum-zinc alloy bath having a mass Z, said bath including an aluminum master alloy addition having a mass Y and a weight fraction X of said carbide compound so that when said master alloy is added to said aluminum-zinc alloy bath in an amount calculated with the following equation $$\frac{X \times Y}{Z + Y} = W \text{ where } X > W$$

so that an effective amount W between about 0.0005% and about 0.01% by weight carbon is present in said carbide compound in said modified coating, said modified coating having a spangle facet size between about 1.5 mm when W is about 0.0005% carbon by weight and 0.2 mm when W is about 0.01% carbon by weight.

9. The article of claim 8, wherein the aluminum-zinc alloy bath contains between about 25% and 70% by weight aluminum.

10. The article of claim 8, further comprising a painted surface on the coated steel article.

11. In an aluminum-zinc steel product coating composition containing between about 25% and 70% by weight aluminum, the improvement comprising the aluminum-zinc alloy including an effective amount of one or more of a particulate compound constituent having a particle size between about 0.01 microns and about 25 microns, said particulate compound constituent selected from the group consisting of titanium boride, a carbide, compound containing titanium, a carbide compound containing vanadium, a carbide compound containing iron, and a carbide compound containing tungsten, whereby when the particulate compound constituent is said titanium boride compound, said improved aluminum-zinc alloy is applied to the product in an aluminum-zinc coating bath having a mass Z, said bath including an aluminum master alloy addition having a mass Y and a weight fraction X of said titanium boride compound so that when said master alloy is added to said aluminum-zinc coating bath in an amount calculated with the following equation $$\frac{X \times Y}{Z + Y} = W \text{ where } X > W$$

an effective amount W comprising between about 0.001% to about 0.5% by weight boron is present in said titanium boride compound in said improved alloy, whereby said titanium boride particles provide a spangle facet size between about 2.0 mm when W is about 0.001% boron by weight and 0.05 mm when W is about 0.5% boron by weight when the aluminum-zinc coating composition is applied to the steel product.

12. The composition of claim 11, wherein said spangle facet size is 0.5 mm.

13. The composition of claim 11, whereby when the particulate compound constituent is said carbide compound, said improved alloy is applied to the product in an aluminum-zinc coating bath having a mass Z, said bath including an aluminum master alloy addition having a mass Y and a weight fraction X of said carbide compound so that when said master alloy is added to said aluminum-zinc coating bath in an amount calculated with the following equation $$\frac{X \times Y}{Z + Y} = W \text{ where } X > W$$

an effective amount W between about 0.0005 and about 0.01% by weight of carbon is present in said carbide compound in said improved alloy, whereby said carbide particles provide a spangle facet size between about 1.5 mm when W is about 0.0005% carbon and 0.2 mm when W is about 0.01% when the aluminum-zinc coating composition is applied to the steel product.

14. In a coated steel article comprising a steel substrate; and an aluminum-zinc coating thereon, the improvement comprising the aluminum-zinc coating modified with an effective amount of at least one particulate compound constituent having a particle size between about 0.01 microns and about 25 microns, said particulate compound constituent selected from the group consisting of a boride compound containing titanium and a boride compound containing aluminum, whereby said aluminum-zinc coating has a spangle facet size of about 0.5 mm and smaller.

15. The article of claim 14, wherein the amount of the particulate compound constituent ranges between about 0.001 and about 0.5% by weight of boron.

16. The article of claim 15, wherein the coating has a spangle facet size of between about 0.05 mm and 0.5 mm.

17. In a coated steel article comprising a steel substrate; and an aluminum-zinc coating thereon, the improvement comprising the aluminum-zinc coating modified with an effective amount of at least one particulate compound constituent having a particle size between about 0.01 microns and 25 microns, said particulate compound constituent selected from the group consisting of an aluminide compound containing titanium and an aluminide compound containing iron, whereby said aluminide particles provide improved spangle facet size reduction having a particle size between about 0.01 microns and about 25 microns, said particulate compound constituent in the aluminum-zinc coating.

18. In a coated steel article comprising a steel substrate; and an aluminum-zinc coating thereon, the improvement comprising the aluminum-zinc coating modified with an effective amount of at least one particulate compound constituent having a particle size between about 0.01 microns and about 25 microns, said particulate compound constituent selected from the group consisting of carbide compound containing titanium, a carbide compound containing vanadium, a carbide compound containing iron, and a carbide compound containing tungsten, whereby said carbide particles provide a spangle facet size of about 0.5 mm and smaller in the aluminum-zinc coating.

19. The article of claim 18, wherein the amount of the particulate compound constituent ranges between about 0.0005 and about 0.01% by weight of carbon.

20. The article of claim 19, wherein the coating has a spangle facet size between about 0.05 mm and 0.5 mm.

21. In an aluminum-zinc steel product coating composition having an aluminum content between 25% and 70% aluminum by weight, the improvement comprising the aluminum-zinc alloy including an effective amount of a particulate compound constituent having a particle size between about 0.01 microns and about 25 microns, said particulate compound constituent consisting of a boride compound containing titanium, whereby said boride compound particles provide a spangle facet size of about 0.5 mm and smaller when the aluminum-zinc alloy and said boride particles are applied to the steel product as a coating.

22. The composition of claim 21, wherein the amount of the particulate compound constituent ranges between about 0.001 and about 0.5% by weight of boron.

23. The invention recited in claim 22, wherein said spangle facet size is between about 0.05 mm and 0.5 mm.

24. In an aluminum-zinc steel product coating composition having an aluminum content between 25% and 70% aluminum by weight, the improvement comprising the aluminum-zinc alloy including an effective amount of at least one particulate compound constituent having a particle size between about 0.01 microns and about 25 microns, said particulate compound constituent selected from the group consisting of carbide compound containing titanium, a carbide compound containing vanadium, a carbide compound containing iron, and a carbide compound containing tungsten, whereby said carbide compound particles provide a spangle facet size of about 0.5 mm and smaller when the aluminum-zinc alloy and said carbide particles are applied to the steel product as a coating.

25. The composition of claim 24, wherein the amount of the particulate compound constituent ranges between about 0.0005 and about 0.01% by weight of carbon.

26. The invention recited in claim 25, wherein said spangle facet size is between about 0.2 mm and 0.5 mm.

27. In a method of coating a steel product using a molten aluminum-zinc alloy bath having an aluminum content between about 25% and 70% aluminum by weight, the improvement comprising:

a) selecting a particulate compound constituent having a particle size between about 0.01 microns and about 25 microns, said particulate compound constituent selected from the group consisting of a boride compound containing titanium, a boride compound containing aluminum, an aluminide compound containing titanium, and aluminide compound containing iron, a carbide compound containing titanium, a carbide compound containing vanadium, a carbide compound containing iron, and a carbide compound containing tungsten;

b) adding an effective amount of one or more of said selected constituent particles to the coating bath;

c) applying said molten coating bath containing the molten aluminum-zinc along with said constituent particles to the steel product; and d) solidifying the molten aluminum-zinc, said constituent particles providing improved spangle facet size of about 0.5 mm and smaller during solidification.

28. In a method of coating a steel product using a molten aluminum-zinc alloy bath, the improvement comprising modifying the composition of the aluminum-zinc alloy by adding an effective amount of one or more of a particulate compound constituent having a particle size between about 0.01 microns and about 25 microns, said particulate compound constituent selected from the group consisting of a boride compound containing titanium, a boride compound containing aluminum, an aluminide compound containing titanium, an aluminide compound containing iron, a carbide compound containing titanium, a carbide compound containing vanadium, a carbide compound containing iron, and a carbide compound containing tungsten, said coating having a spangle facet size of about 0.5 mm and smaller, wherein when the particulate compound constituent is a boride compound, the steps of the method comprise:

a) making an aluminum master alloy bath;

b) adding said boride compound to the master alloy bath in an amount so that said master alloy bath comprises a weight fraction X of boride particulate compound; and c) adding said master alloy bath having a mass Y to the aluminum-zinc alloy bath having a mass Z in an amount calculated with the following equation $$\frac{X \times Y}{Z + Y} = W \text{ where } X > W$$

so that an effective amount W comprising between about 0.001% to about 0.5% by weight boron is present in said particulate compound in the aluminum-zinc alloy bath.

29. The method of claim 28, wherein the particulate compound constituent is one of $TiB_2$, $AlB_2$, and $AlB_{12}$.

30. The method of claim 28, wherein the aluminum-zinc alloy bath contains between about 25% and 70% by weight aluminum.

31. The method of claim 28, further comprising painting the coated steel product without subjecting the coated steel product to skin passing.

32. The method of claim 28, wherein when the particulate compound constituent is a carbide compound, the steps of the method comprise:

a) making an aluminum master alloy bath;

b) adding said carbide compound to the master alloy bath in an amount so that said master alloy bath comprises a weight fraction X of a carbide particulate compound; and c) adding said master alloy bath having a mass Y to the aluminum-zinc alloy bath having a mass Z in an amount calculated with the following equation $$\frac{X \times Y}{Z + Y} = W \text{ where } X > W$$

so that an effective amount W between about 0.0005 and about 0.01% by weight carbon is present in said carbide particulate compound in the aluminum-zinc alloy bath.

33. The method of claim 32, wherein the aluminum-zinc alloy bath contains between about 25% and 70% by weight aluminum.

34. The method of claim 32, further comprising painting the coated steel product without subjecting the coated steel product to skin passing.

35. In a method of coating a steel product using a molten aluminum-zinc alloy bath having an aluminum content between about 25% and 70% aluminum by weight, the improvement comprising modifying the composition of the aluminum-zinc alloy by:

a) selecting a particulate compound constituent having a particle size between about 0.01 microns and about 25 microns, said particulate compound constituent selected from the group consisting of a boride compound containing titanium and a boride compound containing aluminum;

b) adding an effective amount of at least one selected boride compound to the coating bath;

d) applying the molten aluminum-zinc alloy along with said boride compound particles to the steel product; and c) solidifying the aluminum-zinc alloy, said boride compound particles providing a spangle facet size of 0.5 mm and smaller.

36. The method of claim 35, further comprising the step of making a master alloy bath of aluminum and adding an amount of the particulate compound constituents thereto, and then adding the master alloy bath to an aluminum-zinc coating bath in proportions to attain the effective amount of the particulate compound constituent.

37. The method of claim 35, wherein the amount of the particulate compound constituent in the alloy bath ranges between about 0.001 and about 0.5% by weight of boron.

38. The method recited in claim 37, wherein said spangle facet size is between about 0.05 mm and 0.5 mm.

39. In a method of coating a steel product using a molten aluminum-zinc alloy bath having an aluminum content between about 25% and 70% aluminum by weight, the improvement comprising modifying the composition of the aluminum-zinc alloy by:

a) selecting a particulate compound constituent having a particle size between about 0.01 microns and 25 microns, said particulate compound constituent selected from the group consisting of an aluminide compound containing titanium and an aluminide compound containing iron;

b) adding an effective amount of at least one selected aluminide compound to the bath so that the bath comprises the molten aluminum-zinc alloy and particles of said aluminide compound;

e) applying the molten aluminum-zinc alloy and said aluminide compound particles to the steel product; and c) solidifying the aluminum-zinc alloy, said aluminide particles providing improved spangle facet size reduction of about 0.5 mm and smaller.

40. The method of claim 39, further comprising the step of making a master alloy bath of aluminum and adding an amount of the particulate compound constituents thereto, and then adding the master alloy bath to an aluminum-zinc coating bath in proportions to attain the effective amount of the particulate compound constituent.

41. In a method of coating a steel product using a molten aluminum-zinc alloy bath having an aluminum content between about 25% and 70% aluminum by weight, the improvement comprising modifying the composition of the aluminum-zinc alloy by:

a) selecting a particulate compound constituent having a particle size between about 0.01 microns and about 25 microns, said particulate compound constituent selected from the group consisting of a carbide compound containing titanium, a carbide compound containing vanadium, a carbide compound containing iron, and a carbide compound containing tungsten;

b) adding an effective amount of at least one selected carbide compound to the bath;

f) applying the molten aluminum-zinc alloy along with said carbide particles to the steel product; and c) solidifying the aluminum-zinc coating, said carbide particles providing a facet size of about 0.5 mm and smaller.

42. The method of claim 41, further comprising the step of making a master alloy bath of aluminum and adding an amount of the particulate compound constituents thereto, and then adding the master alloy bath to an aluminum-zinc coating bath in proportions to attain the effective amount of the particulate compound constituent.

43. The method of claim 41, wherein the amount of the particulate compound constituent in the alloy bath ranges between about 0.0005 and about 0.01% by weight of carbon.

44. The method recited in claim 43, wherein said spangle facet size is between about 0.2 mm and 0.5 mm.

* * * * *